US005791263A

United States Patent [19]

Watt et al.

[11] Patent Number: 5,791,263

[45] Date of Patent: Aug. 11, 1998

[54] ADJUSTABLE WORK SURFACE

[75] Inventors: Richard L. Watt; Donald R. Pangborn, both of Jamestown, N.Y.

[73] Assignee: Weber Knapp Company, Jamestown, N.Y.

[21] Appl. No.: 522,426

[22] Filed: Sep. 12, 1995

Related U.S. Application Data

[63] Continuation of Ser. No. 95,854, Jul. 23, 1993, abandoned.

[51] Int. Cl.[6] ..... A47B 11/00

[52] U.S. Cl. ..... 108/138; 108/7; 248/918

[58] Field of Search ..... 108/138, 143, 108/137, 145, 149, 9, 8, 7; 248/284, 424, 429, 920, 923, 918; 312/208.1

[56] References Cited

U.S. PATENT DOCUMENTS

| | | | |
|---|---|---|---|
| 3,866,866 | 2/1975 | Kneile | 108/138 X |
| 4,644,875 | 2/1987 | Watt | 108/143 X |
| 4,776,284 | 10/1988 | McIntosh | 108/138 |
| 4,923,259 | 5/1990 | Bartok | 108/143 X |
| 4,938,441 | 7/1990 | Hannah et al. | 108/143 X |
| 5,294,087 | 3/1994 | Drabczyk | 108/138 X |

*Primary Examiner*—Jose V. Chen

*Attorney, Agent, or Firm*—Bean, Kauffman & Snyder

[57] ABSTRACT

A mounting assembly is disclosed for mounting an auxiliary device, such as a keyboard support or work surface, for vertical movement relative to a support, such as a desk top. The assembly permits upwardly directed movement of the auxiliary device while releasably constraining downwardly directed movement relative to the support, and includes a linkage assembly coupled with a brake assembly fixed relative to the support. The auxiliary device is released for downwardly directed movement by manually operated paddle coupled with the brake assembly and movable with the auxiliary device.

24 Claims, 5 Drawing Sheets

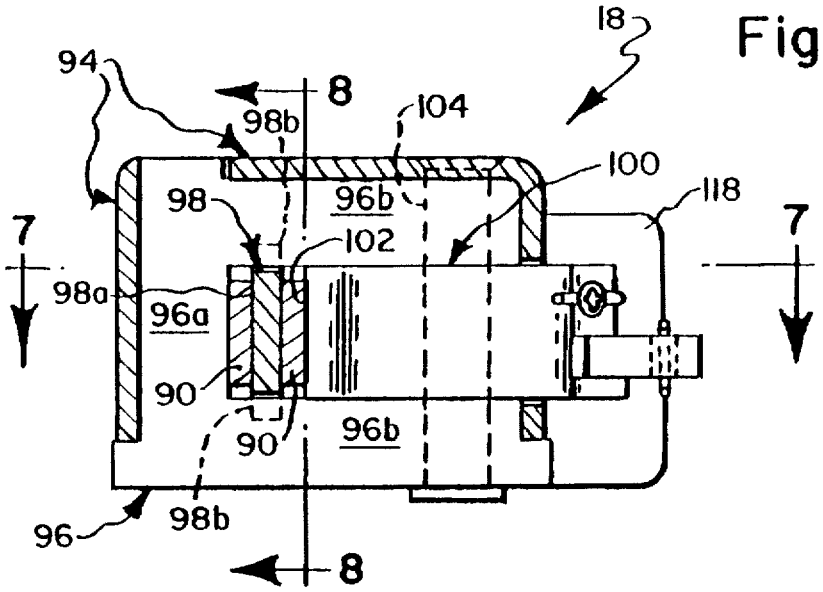
Fig. 6.
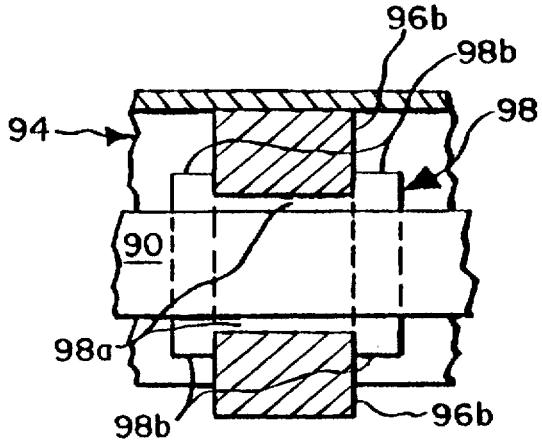
Fig. 8.
Fig. 7.
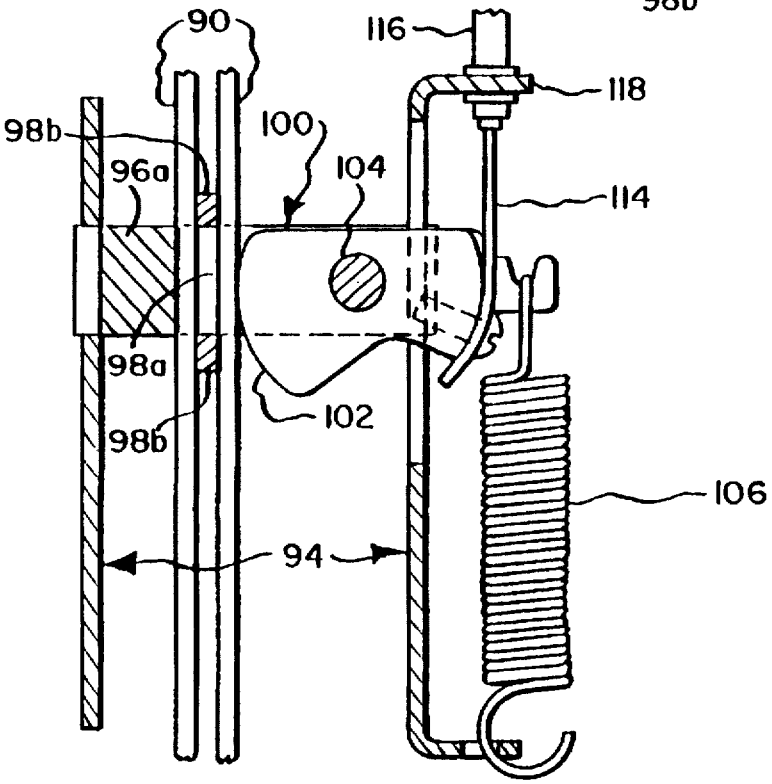

ADJUSTABLE WORK SURFACE

This is a continuation of application Ser. No. 08/095,854 filed on Jul. 23, 1993, now abandoned.

BACKGROUND OF THE INVENTION

Heretofore, various mechanisms have been devised for use in supporting an auxiliary device, such as a computer keyboard supporting panel or work surface, for vertical movement relative to a support, such as a desk or table top.

In commonly assigned prior U.S. Pat. No. 4,644,875, a mechanism of the type generally described above includes a pair of transversely spaced parallelogram linkages adapted for connection adjacent their opposite ends to the auxiliary device and the support and adapted for connection to each other for conjunctive movement by a torsion rod extending transversely therebetween. The linkages are associated with tension springs, which provide a bias tending to counterbalance the weight of the auxiliary device, and manually operated clamping knobs movable with the auxiliary device are employed to releasably lock the latter in a desired vertical position.

In prior U.S. Pat. No. 213,775 and in commonly assigned U.S. Pat. No. 4,625,657, there are disclosed mechanisms of the type generally described above, wherein a manually operated lever movable with an auxiliary device is employed to control operation of a remotely located latch device associated with a parallelogram linkage.

SUMMARY OF THE INVENTION

The present invention generally relates to parallelogram linkage type mechanisms adapted for use in supporting an auxiliary device for vertical movement relative to a support.

In accordance with the present invention, a mounting assembly is provided for supporting an auxiliary device, such as a keyboard supporting panel or work surface, whereby to permit upwardly directed movement of the auxiliary device relative to a support, such as a table or desk top, and while releasably constraining the auxiliary device against downwardly directed movement relative to the support. The mounting assembly includes a pair of transversely spaced parallelogram linkages connected for conjunctive movement by a torsion member extending transversely between the linkages and a brake assembly fixed relative to the support and coupled with the linkages to permit upwardly directed movement of the auxiliary device, while releasably constraining downwardly directed movement. Links carried by the torsion member move in opposite directions relative to the brake assembly in response to upwardly and downwardly directed movement of the auxiliary device, and a oneway clamping means provided in the brake assembly is spring-biased for abutment with the links to prevent movement of the links relative to the brake assembly in a direction corresponding to downwardly directed movement of the auxiliary device. The brake assembly may be released to permit downwardly directed movement of the auxiliary device by manual operator means coupled with the clamping means, as by a cable, which acts against the spring bias to urge the clamping means away from abutting engagement with the links to allow motion of the links in a direction corresponding to downward motion of the auxiliary device.

BRIEF DESCRIPTION OF THE DRAWINGS

The nature and mode of operation of the present invention will now be more fully described in the following detailed description taken with the accompanying drawings wherein:

FIG. 6 is an enlarged sectional view taken generally along line 6—6 in FIG. 2;

FIG. 7 is a sectional view taken generally along line 7—7 in FIG. 6; and FIG. 8 is a sectional view taken generally along line 8—8 in FIG. 6.

DETAILED DESCRIPTION

Figure 1:
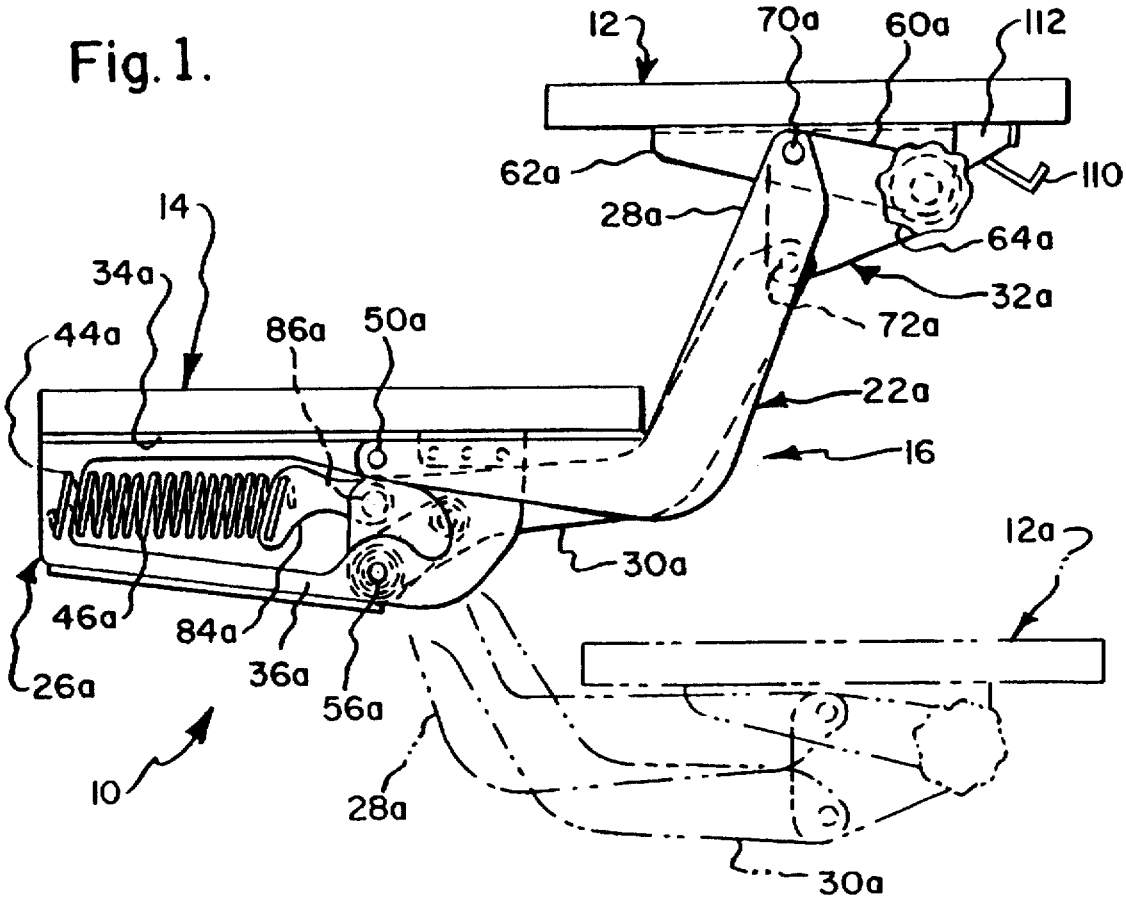
FIG. 1 is a side elevational view of a mounting assembly formed in accordance with the present invention.

Reference is first made to FIG. 1, wherein a mounting assembly formed in accordance with the present invention is generally designated as 10, and shown as being adapted for use in mounting an auxiliary device 12 for vertical movement relative to a support 14 between selected upper and lower positions shown for example in full and broken line, respectively. Auxiliary device 12 may be any desired art device, such as for example, a keyboard supporting shelf, a monitor supporting shelf or a work surface, whereas support 14 may be suitably defined, such as for example by a table or desk top. Accordingly, the specific constructions of auxiliary device 12 and support 14 form no part of the present invention.

Figure 2:
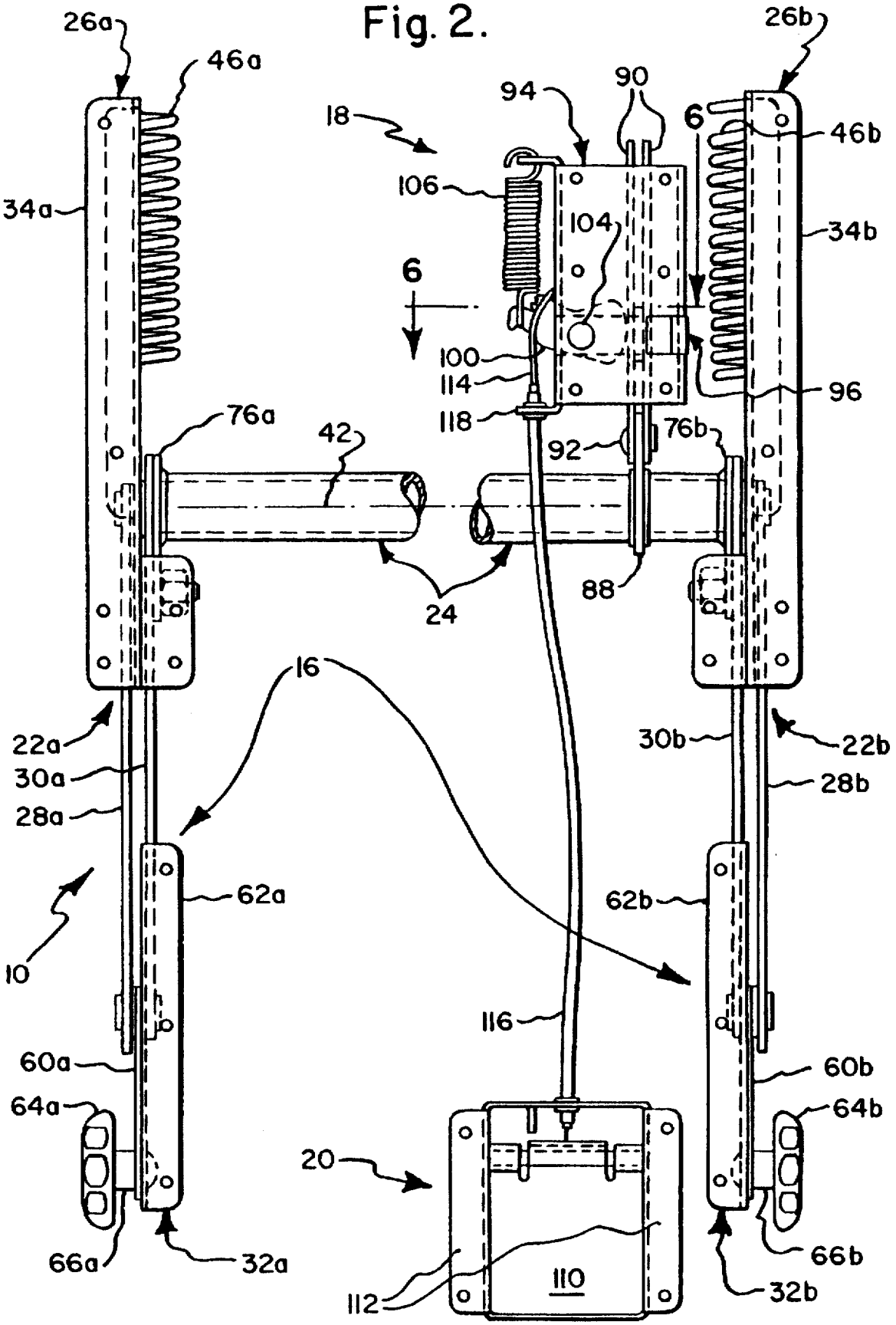
FIG. 2 is an enlarged, fragmentary top plan thereof.
Figure 3:
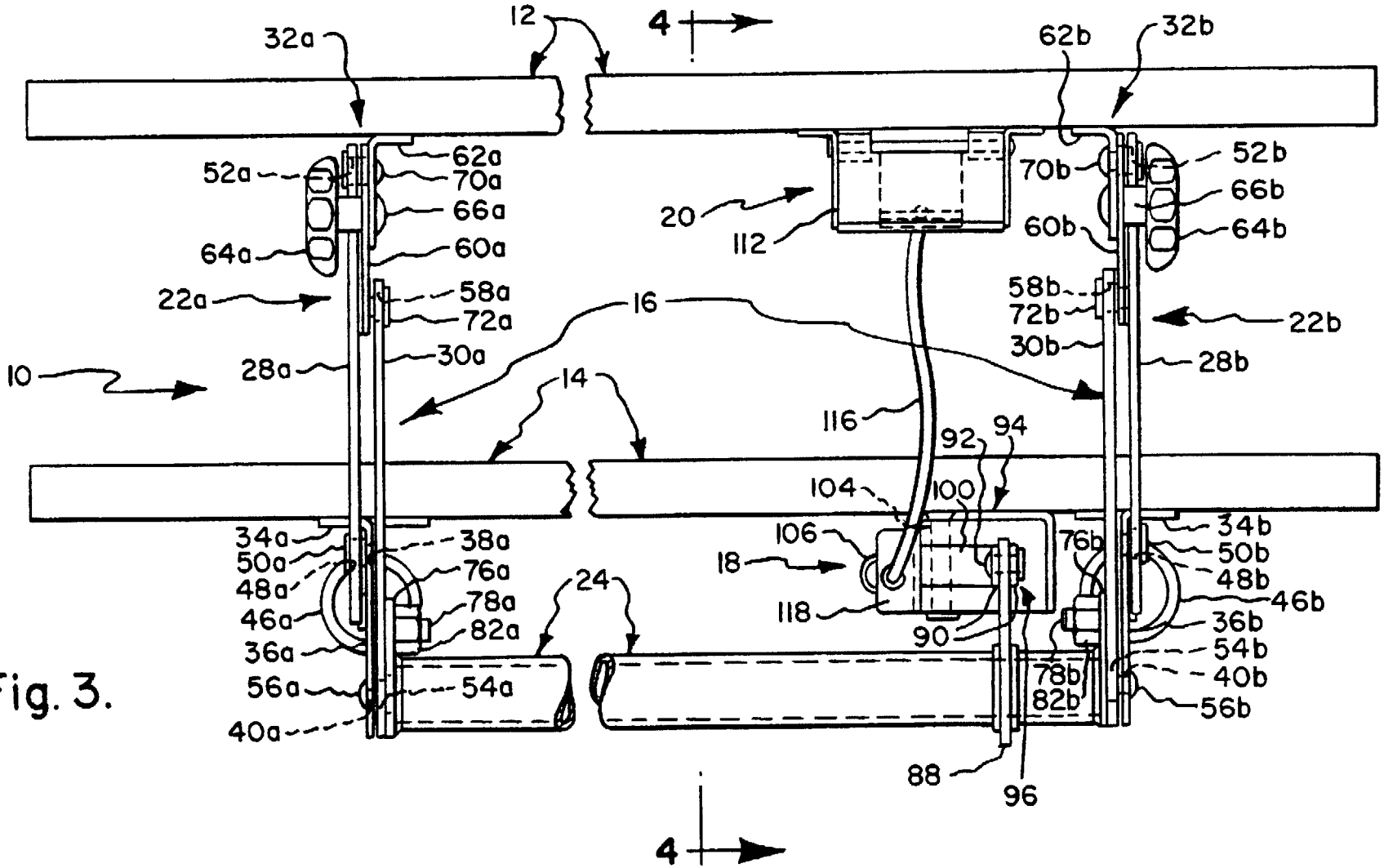
FIG. 3 is an enlarged, fragmentary front elevational view thereof.

Mounting assembly 10 is shown in FIGS. 1–3 as generally including a linkage assembly 16 for supporting auxiliary device 12 for vertical movement relative to support 14; a brake assembly 18 suitably fixed relative to the support and coupled with the linkage assembly for releasably constraining the auxiliary device against downwardly directed movement relative to the support, while permitting upwardly directed movement of the auxiliary device relative thereto; and a manual operator means 20 for the brake assembly, which is moveable with the auxiliary device and coupled with the brake assembly for releasing the auxiliary device for downwardly directed movement. Thus, it is generally contemplated that in accordance with a preferred embodiment of the present invention, brake assembly 18 will normally tend to lock auxiliary device 12 against downwardly directed movement under loadings intended to be applied thereto during use, while allowing the auxiliary device to be manually elevated to a desired position by a user, and will further allow the auxiliary device to be intentionally moved to a lower position upon manual operation of operator means 20 by the user.

Linkage assembly 16 is shown in FIGS. 2 and 3 as generally including a pair of transversely spaced linkages **22*a* and 22*b*, which are adapted to be individually fixed adjacent their opposite ends to auxiliary device 12 and support 14 and connected for conjunctive movement by a common torsion member 24** extending transversely between the linkages.

Figure 5:
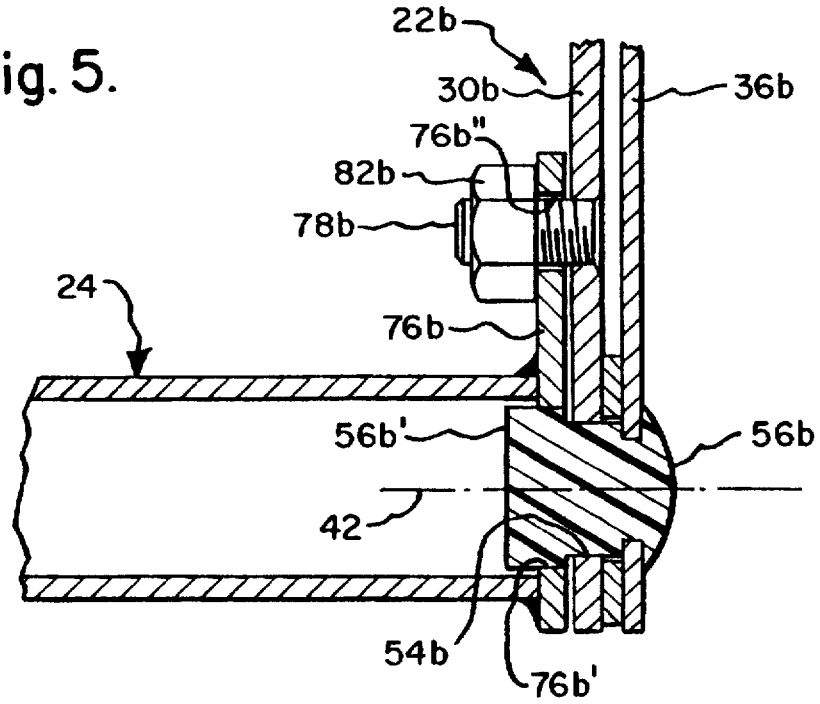
FIG. 5 is an enlarged sectional view taken generally along line 5—5 FIG. 4.

Linkages **22*a* and 22*b* are of like construction in that they include mounting brackets 26*a* and 26*b*; upper links 28*a* and 28*b*; lower links 30*a* and 30*b*; and auxiliary device supporting bracket assemblies 32*a* and 32*b*. Mounting brackets 26*a* and 26*b* are of generally L-shaped configuration having support mounting flange portions 34*a* and 34*b* adapted for suitable attachment to a lower surface of support 14; and depending link mounting flange portions 36***a* and 36*b* having aligned upper link supporting openings 38*a* and 38*b* for use in supporting rear ends of upper links 28*a* and 28*b* for pivotal movement about a first horizontally disposed hinge axis, not shown, aligned lower link supporting openings 40*a* and 40*b* for use in supporting rear ends of lower links 30*a* and 30*b* for pivotal movement about a second horizontally disposed hinge axis 42 shown in FIG. 5 as being arranged in alignment with torsion member 24, and openings 44*a* and 44*b* for mounting rearwardly disposed ends of a pair of counterbalance springs 46*a* and 46*b*.

Upper links 28*a* and 28*b* are in the form of generally L-shaped plates having rear bearing openings 48*a* and 48*b* journalled in alignment with upper link supporting openings 38*a* and 38*b* by upper pivot pins 50*a* and 50*b*, and front bearing openings 52*a* and 52*b*. Lower links 30*a* and 30*b* are also in the form of generally L-shaped plates having rear bearing openings 54*a* and 54*b* journalled in alignment with lower link supporting openings 40*a* and 40*b* by pivot pins 56*a* and 56*b*, and front bearing openings 58*a* and 58*b*.

Figure 4:
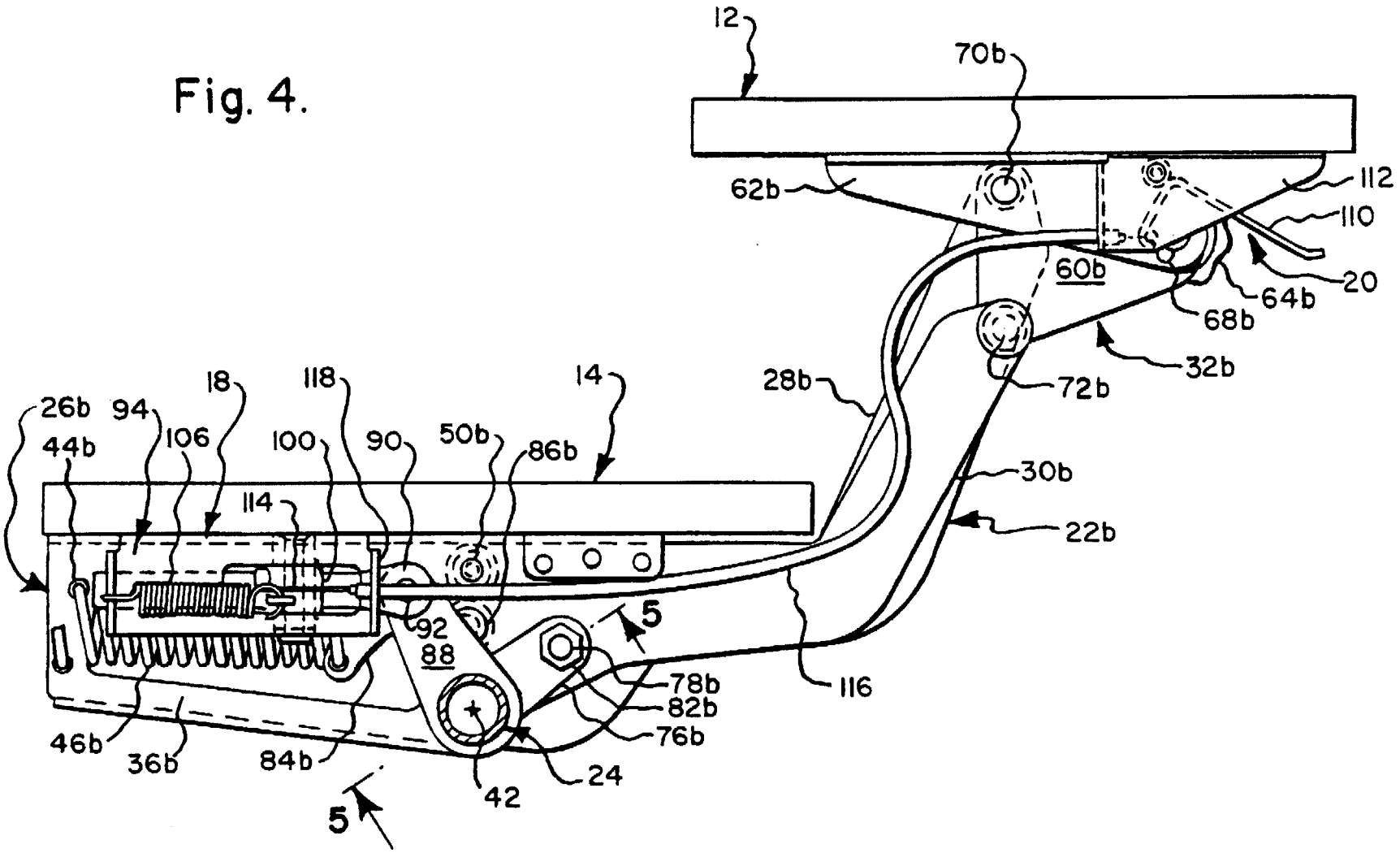
FIG. 4 is a sectional view taken generally along line 4—4 in FIG. 3.

Bracket assemblies 32*a* and 32*b* include link plates 60*a* and 60*b*, L-shaped device mounting brackets 62*a* and 62*b*, and device tilt adjustment means including manually operated clamping knobs 64*a* and 64*b* and threaded studs 66*a* and 66*b*, which extend through apertures, not shown, formed in the link plates and arcuate slots, shown only for the case of slot 68*b* in FIG. 4. Pivot pins 70*a* and 70*b* extend through front bearing openings 52*a* and 52*b* of upper links 28*a* and 28*b*, and through aligned openings, not shown, in link plates 60*a* and 60*b* and mounting brackets 62*a* and 62*b* for connecting the front ends of the upper links to the link plates and mounting brackets, as well as the link plates to the mounting brackets, for pivotal movement about a third horizontally disposed hinge axis, not shown. Pivot pins 72*a* and 72*b* extend through front bearing openings 58*a* and 58*b* of lower links 30*a* and 30*b* and aligned apertures, not shown, in link plates 60*a* and 60*b* for connecting the front ends of the lower links to the link plates for pivotal movement about a forth horizontally disposed hinge axis, not shown. The pivotal position of mounting brackets 62*a* and 62*b*, and thus device 12, relative to link plates 60*a* and 62*b* may be adjustably fixed by tightening knobs 64*a* and 64*b*.

In the presently preferred construction, the first, second, third and forth hinge axes are parallel and arranged to permit linkages 22*a* and 22*b* to function as parallelogram linkages.

Further, in the presently preferred construction, torsion member 24 is in the form of a tube having its opposite ends positionally fixed to linkages 22*a* and 22*b*, as by pivot pins 56*a* and 56*b*. The opposite ends of tube 24 are also releasably and rigidly fixed to linkages 22*a* and 22*b* by a pair of torsion plates 76*a* and 76*b* for purposes of normally retaining pivot pins 56*a* and 56*b* within the ends of the tube and permitting the tube to function as a torsion member. Torsion plates 76*a* and 76*b* have first ends rigidly fixed, such as by welding, to the open ends of tube 24 peripherally of pivot pin supporting openings formed therein and shown in FIG. 5 only for the case of opening 76*b*'. Torsion plates 76*a* and 76*b* also have second or remote ends removably rigidly fixed, such as by threaded studs 78*a* and 78*b*, which are mounted by lower links 30*a* and 30*b* and arranged to extend through mounting openings in the torsion plates, shown only for the case of mounting opening 76*b*" in FIG. 5, and clamping nuts 82*a* and 82*b* threaded onto the threaded studs for clamping the torsion plates against the lower links. Pivot pins 56*a* and 56*b* are provided with enlarged facing or relatively inner ends, shown in FIG. 5 only for the case of end 56*b*', which are suitably sized for removable slidable receipt within pin openings provided in the first ends of torsion plates 76*a* and 76*b* and clearance fit within the open ends of the tube. Alternatively, the pivot pin openings of the torsion plates may be enlarged and the facing ends of pivot pins 56*a* and 56*b* slidably received and journalled by the ends of torsion member 24. With this arrangement, the linkage assembly 16 may be shipped in a "knocked-down" condition and linkages 22*a* and 22*b* interconnected at a point of use by sliding the inner or facing ends of pivot pins 56*a* and 56*b* through the pin openings in torsion plates 76*a* and 76*b* into the opposite, open ends of tube 24 and sliding threaded studs 78*a* and 78*b* into the mounting openings of torsion plates 76*a* and 76*b*, and thereafter retaining the linkage assembly in assembled condition by threading clamping nuts 82*a* and 82*b* onto the threaded studs. Linkage assembly 16 may be joined to device 10 and support 14 before or after its assembly, as is desired.

Linkage assembly 16 also includes counterbalance connection means, such as connecting plates 84*a* and 84*b* shown in FIGS. 1 and 4 as being carried by lower links 30*a* and 30*b* via pivot pins 86*a* and 86*b*, for use in connecting the linkage assembly to the front ends of counterbalance springs 46*a* and 46*b*. Linkage assembly 16 also includes link means, defined by a link 88 rigidly fixed to torsion member 24 for movement in opposite directions incident to upwardly and downwardly directed movements of auxiliary device 12, and one or more friction links 90 pivotally connected to link 88 by pivot pin 92 for operably connecting the linkage assembly to brake assembly 18.

Brake assembly 18 is best shown in FIGS. 6–8 as generally including a generally U-shaped housing 94 adapted to be suitably fixed to depend from a lower surface of support 14; a generally U-shaped guide member 96 supported to extend transversely within the housing and having an upstanding base or abutment portion 96*a* and a pair of horizontally extending leg portions 96*b* and 96*b* cooperating to slidably support friction links 90 for movement transversely of the guide member; friction means 98 carried by the leg portions and arranged for engagement with facing surfaces of the friction links; a clamping lever 100 having a generally arcuate clamping surface 102 and being mounted for pivotal movement relative to housing 94 and guide member 96 by a pivot pin 104; and a spring 106 tending to bias the clamping lever for pivotal movement in a first direction, ie. clockwise as viewed in FIG. 7, for urging clamping surface 102 into surface engagement with friction links 90.

Friction means 98 is preferably in the form of a flat plate member having an H-shaped configuration and being formed from or coated with a suitable friction material. This plate member has a flat bridging portion 98*a*, which is arranged to extend between guide leg portions 96*b* and 96*b* for engagement with facing surfaces of adjacent links 90 and 90, and two pairs of free end portions 98*b* and 98*b*, which are arranged for straddling engagement with the guide leg portions.

Preferably, the distance between clamping surface 102 and the axis of pivot pin 104 increases in a counterclockwise direction, as viewed in FIG. 7, whereby the bias of spring 106 and/or the tendency of links 90 to move relative to brake assembly 18 in a direction corresponding to downwardly directed or lowering movement of auxiliary device 12, will tend to pivot clamping lever 100 in a clockwise direction, also as viewed in FIG. 7, and thereby to move the clamping surface progressively towards guide abutment portion 96*a* and friction means 98 and increase the clamping force applied by the clamping lever to the links. On the other hand, movement of links 90 in an opposite direction corresponding to upwardly directed or rising movement of auxiliary device 12 will tend to pivot clamping lever 100 in a counterclockwise direction, as viewed in FIG. 7, with the result that the clamping force applied by the clamping lever will be decreased. Accordingly, it will be understood that the construction of brake assembly 18 is such that it normally serves to releasably constrain auxiliary device 12 against downwardly directed movement relative to support 14, while permitting upwardly directed movement relative thereto under lifting force applied by a user.

Operator means 20 is shown in FIGS. 2–4, as including a generally L-shaped paddle 110, which is supported beneath auxiliary device 12 by a mounting bracket 112 for vertical movement with the auxiliary device and pivotal movement about a generally horizontally disposed axis arranged parallel to the pivot axes of linkage 16; and a cable 114, which has a forwardly disposed end fixed to paddle 110 and a rearwardly disposed end fixed to clamping lever 100. Preferably, cable 114 is slidably enclosed within a tubular shaft or cover 116 having its forwardly disposed end fixed to mounting bracket 112 and its rearwardly disposed end fixed to a mounting tab 118 formed integrally with brake assembly housing 94. With this arrangement, paddle 110 is normally disposed in the pivotal position shown in FIG. 4, which corresponds to the normally operable condition of brake assembly 18. When it is desired to release brake assembly 18, a user would simply lift the front end of paddle 110, such as to effect counterclockwise directed pivotal movement of the paddle as viewed in FIG. 4 and thereby exert a pulling force on the front end of cable 114. This pulling force is transmitted by cable 114 to clamping lever 100, which is caused thereby to undergo counterclockwise directed pivotal movement, as viewed in FIG. 7, against the return bias of spring 106. This pivotal movement of clamping lever 100 moves clamping surface 102 in a direction away from links 90 in order to free the links for sliding movement relative to brake assembly 18 and permit auxiliary device 12 to be freely moved upwardly or downwardly, as desired by the user.

The number of links 90 employed will depend upon installation operating requirements. Thus, for example, if the load requirements established by auxiliary device 12 are sufficiently small, a single link 90 can be used. However, even for light loading conditions, it is preferable to employ two links in order to provide for uniform loading of link 88 and pivot pin 92, and to arrange a single friction member between such links. The number of links employed would also depend upon the amount of resistance desired to be provided to oppose user induced upwardly directed or lifting movement of auxiliary device 12, while brake assembly 18 is in its normal operable position. Thus, if a minimum resistance is desired, a minimum number of links 90 would be employed, as consistent with the requirements for preventing downward movement of auxiliary device 12 when brake assembly 18 is in operation. On the other hand, resistance may be increased to an extent desired, by adding additional links 90 and friction members 98 in order to increase the friction surface area available to oppose sliding movement of the links relative to the brake assembly.

What is claimed is:

1. A mounting assembly for mounting an auxiliary device for vertical movement relative to a support, said assembly comprising:

a linkage assembly for supporting said auxiliary device for vertical movement relative to said support, said linkage assembly includes link means movable in opposite directions relative to said brake assembly in response to upwardly and downwardly directed movements of said auxiliary device; a brake assembly fixed relative to said support and coupled with said linkage assembly for releasably constraining said auxiliary device against downwardly directed movement relative to said support, while permitting said auxiliary device to be manually elevated, said brake assembly includes clamping means for releasably clamping said link means for preventing movement in one direction corresponding to downwardly directed movement of said auxiliary device; and manual operator means for brake assembly, said operator means being movable with said auxiliary device and coupled to said brake assembly for releasing said auxiliary device for downwardly directed movement relative to said support, and said operator means is coupled to said clamping means.

2. A mounting assembly according to claim 1, wherein said linkage assembly includes a pair of transversely spaced linkages connected for conjunctive movement by a torsion member extending transversely therebetween, and said link means is carried by said torsion member.

3. A mounting assembly according to claim 2, wherein each said linkages includes a movable link, said torsion member has opposite ends thereof positionally fixed one to each said movable link, and a pair of torsion plates have first ends rigidly fixed one to each of said ends of said torsion member and second ends rigidly fixed one to each said movable link remotely of said torsion member.

4. A mounting assembly according to claim 3, wherein said torsion member is a tube, said opposite ends are releasably fixed one to each said movable link by a pair of pin means carried by said linkages for removable receipt within said opposite ends of said tube, and said second ends of said torsion plates have through mounting openings and said second ends are releasably fixed one to each said movable link by threaded studs carried thereby for removable receipt within said mounting openings and clamping nuts removably fixed to said threaded studs for clamping said torsion plates against said movable links of said linkages.

5. A mounting assembly according to claim 4, wherein said linkage assembly includes a pair of mounting brackets for mounting said linkages on said support, said mounting brackets include supporting openings, said movable links of said linkages including bearing openings, said pin means extend through said supporting openings and said bearing openings for receipt within said opposite ends of said tube, and said first ends of said torsion plates have openings aligned with said opposite ends of said tube for supporting said pin means received within said opposite ends of said tube.

6. A mounting assembly according to claim 1, wherein said clamping means includes guide means for supporting said link means for movement relative to said brake assembly, a clamping lever supported for pivotal movement relative to said guide means and having a clamping surface arranged for clamping engagement with said link means, and spring means tending to pivot said clamping lever in a first direction for clamping said link means for preventing movement thereof in said one direction, and said operator means is connected to said clamping lever for pivoting said clamping lever in a second direction to release said clamping surface from clamping engagement with said link means.

7. A mounting assembly for mounting an auxiliary device for vertical movement relative to a support, said assembly comprising:

a linkage assembly for supporting said auxiliary device for vertical movement relative to said support, said linkage assembly includes link means movable in opposite directions relative to said brake assembly in response to upwardly and downwardly directed movements of said auxiliary device;

a brake assembly fixed relative to said support and coupled with said linkage assembly for releasably constraining said auxiliary device against downwardly directed movement relative to said support, while permitting said auxiliary device to be manually elevated, said brake assembly includes a housing fixed relative to said support, a generally U-shaped guide member supported by said housing and having a base portion and a pair of leg portions for supporting said link means therebetween for movement relative to said brake assembly in a direction extending transversely of said guide member, friction means carried by said leg portions and arranged for engagement with said link means, a clamping lever mounted by at least one of said housing and said leg portions for pivotal movement, said clamping lever having a clamping surface, and spring means tending to bias said clamping lever for pivotal movement in a first direction for moving said clamping surface relatively towards said friction means for clamping said link means therebetween to prevent movement of said link means in one direction corresponding to downwardly directed movement of said auxiliary device; and manual operator means for brake assembly, said operator means being movable with said auxiliary device and coupled to said brake assembly for releasing said auxiliary device for downwardly directed movement relative to said support, and said operator means includes a cable connected to said clamping lever for pivoting said clamping lever for movement in a second direction against said bias of said spring means for moving said clamping surface relatively away from said friction means.

8. A mounting assembly according to claim 7, wherein said linkage assembly includes a pair of transversely spaced linkages connected for conjunctive movement by a torsion member extending transversely therebetween, and said link means is carried by said torsion member.

9. A mounting assembly according to claim 8, wherein said link means includes at least a pair of links, said friction means includes a plate member disposed intermediate of and for frictional engagement with said pair of links, and said plate member being of generally H-shaped configuration having a bridging portion extending between said pair of leg portions and arranged for frictional engagement with said pair of links and two pairs of free end portions arranged for straddling engagement with said pair of leg portions.

10. A mounting assembly for mounting an auxiliary device for vertical movement relative to a support, said assembly comprising:

a linkage assembly for supporting said auxiliary device for vertical movement relative to said support, said linkage assembly includes a pair of spaced linkages each having a movable link and coupling means for coupling said linkages for conjunctive movement incident to said vertical movement of said auxiliary device, said coupling means includes a torsion member extending transversely between said linkages and having opposite ends thereof positionally fixed one to each said movable link, and a pair of torsion plates having first ends rigidly fixed one to each of said opposite ends of said torsion member and second ends rigidly fixed one to each said movable link remotely of said torsion member;

a brake assembly fixed relative to said support and coupled with said linkage assembly for releasably constraining said auxiliary device against downwardly directed movement relative to said support, while permitting said auxiliary device to be manually elevated; and manual operator means for brake assembly, said operator means being movable with said auxiliary device and coupled to said brake assembly for releasing said auxiliary device for downwardly directed movement relative to said support.

11. A mounting assembly according to claim 10, wherein the movable links of said linkages have openings arranged for alignment with said opposite ends of said torsion member and said opposite ends of said torsion member are positionally fixed relative to said movable links by a pair of pin means extending through said openings and into mounting openings defined by said first ends of said torsion plates.

12. A mounting assembly according to claim 10, wherein said torsion member is a tube, said opposite ends are releasably positionally fixed to the movable links of said linkages by pin means carried by said linkages for removable receipt within said opposite ends of said tube, and said second ends of said torsion plates have through mounting openings and said second ends are releasably rigidly fixed to the movable links of said linkages by threaded studs carried by said movable links for removable receipt within said mounting openings and clamping nuts removably fixed to said threaded studs for clamping said torsion plates against said movable links.

13. A mounting assembly according to claim 12, wherein said linkage assembly includes a pair of mounting brackets for mounting said linkages on said support, said mounting brackets include supporting openings, said movable links of said linkages including bearing openings, said pin means extend through said supporting openings and said bearing openings for receipt within said opposite ends of said tube, and said first ends of said torsion plates have mounting openings aligned with said opposite ends of said tube for supporting said pin means received within said opposite ends of said tube.

14. A mounting assembly for mounting an auxiliary device for vertical movement relative to a support, said assembly comprising:

a linkage assembly having a pair of linkages having opposite ends for connection to said auxiliary device and said support, each of said linkages includes a movable link; and a torsion member for connecting said linkages for conjunctive movement, said torsion member having opposite ends positionally fixed one to each said movable link and a pair of torsion plates having first ends rigidly fixed one to each of said ends of said torsion member and second ends rigidly fixed one to each said movable link remotely of said torsion member.

15. A mounting assembly according to claim 14, wherein said torsion member is a tube, said opposite ends are releasably positionally fixed one to each said movable link by a pair of pin means carried by said linkages for removable receipt within said opposite ends of said tube, and said second ends of said torsion plates have through mounting openings and said second ends are releasably rigidly fixed to the movable links of said linkages by threaded studs carried thereby for removable receipt within said mounting openings and clamping nuts removably fixed to said threaded studs for clamping said torsion plates against said movable links of said linkages.

16. A mounting assembly according to claim 15, wherein said linkage assembly includes a pair of mounting brackets for mounting said linkages on said support, said mounting brackets include supporting openings, said movable links of said linkages including bearing openings, said first ends of said torsion plates include pin mounting openings, and said pin means extend through said supporting openings and said bearing openings and said pin mounting openings for receipt within said opposite ends of said tube.

17. A mounting assembly according to claim 14, wherein said linkage assembly additionally includes a pair of transversely spaced mounting brackets for mounting said linkages on said support, said mounting brackets having pairs of upper and lower link supporting openings arranged for relative alignment, said linkages each include upper and lower movable links supported for pivotal movement relative to said mounting brackets about upper and lower axes aligned with said supporting openings, said upper and lower movable links having bearing openings aligned with said supporting openings, said torsion member is a tube having said opposite ends thereof aligned with one of said axes, said opposite ends of said tube are releasably positionally fixed by pin means fixed within said supporting openings aligned with said one of said axes and freely extending through aligned ones of said bearing openings of said links and into said ends of said tube, and said second ends of said torsion plates are releasably rigidly fixed to ones of said movable links whose bearing openings are aligned with said one of said axes by threaded studs projecting from said ones of said movable links for receipt within mounting openings defined by said second ends and nuts threaded onto said studs for clamping said second ends against said ones of said movable links.

18. A mounting assembly for mounting an auxiliary device for vertical movement relative to a support, said assembly comprising:

a linkage assembly for supporting said auxiliary device for vertical movement relative to said support, said linkage assembly includes link means movable in opposite directions in response to upwardly and downwardly directed movements of said auxiliary device;

a brake assembly fixed relative to said support for releasably constraining said auxiliary device against movement, said brake assembly includes clamping means for releasably clamping said link means, said clamping means includes a pivotally supported clamping lever having a clamping surface arranged for clamping engagement with said link means, and spring means tending to pivot said clamping lever in a first direction for clamping against said link means for preventing movement thereof in one direction corresponding to downwardly directed movement of said auxiliary device, said clamping surface being arranged to increase clamping force applied to said link means by said clamping lever as said clamping lever is pivoted in said first direction, said clamping engagement of said clamping surface with said link means establishing a frictional force opposing movement of said link means in another direction corresponding to upwardly directed movement of said auxiliary device; and manual operator means for releasing said brake assembly, said operator means being movable with said auxiliary device and coupled to said clamping lever for pivoting said clamping lever in a second direction opposite to said first direction for releasing said clamping surface from clamping engagement with said link means.

19. A mounting assembly according to claim 18, wherein said link means includes at least one pair of links having facing surfaces, said clamping means additionally includes a generally U-shaped guide member having a base portion and a pair of leg portions receiving said links therebetween for movement relative to said brake assembly in a direction extending transversely of said guide member, at least one friction member carried by said leg portions and arranged for frictional engagement with said facing surfaces of said links and said clamping surface is movable by said spring means relatively towards said base portion for clamping said links and said friction member therebetween.

20. A mounting assembly according to claim 19, wherein said friction member has a generally H-shaped configuration defined by a bridging portion extending between said pair of leg portions and arranged for frictional engagement with said facing surfaces of said links and two pairs of free end portions arranged for straddling engagement with said pair of leg portions.

21. A mounting assembly according to claim 19, wherein said linkage assembly includes a pair of spaced linkages and coupling means for coupling said linkages for conjunctive movement incident to said vertical movement of said auxiliary device; and said coupling means includes a torsion member extending transversely between said linkages and having opposite ends thereof positionally fixed relative to said linkages, and a pair of torsion plates having first ends rigidly fixed one to each of said opposite ends of said torsion member and second ends rigidly fixed one to each of said linkages remotely of said torsion member.

22. A mounting assembly according to claim 21, wherein said torsion member is a tube, said opposite ends are releasably positionally fixed to said linkages by pin means carried by said linkages for removable receipt within said opposite ends of said tube, said second ends of said torsion plates have through mounting openings, and said second ends are releasably rigidly fixed to said linkages by threaded studs carried by said linkages for removable receipt within said mounting openings and clamping nuts removably fixed to said threaded studs for clamping said torsion plates against said linkages.

23. A mounting assembly for mounting an auxiliary device for vertical movement relative to a support, said assembly comprising:

a linkage assembly having a pair of linkages having opposite ends for connection to said auxiliary device and said support, each of said linkages including a mounting bracket, a movable link and means for pivotally supporting said movable link on said bracket for pivotal movement about an axis;

a torsion member for connecting said linkages for conjunctive movement, said torsion member having opposite ends;

means for positionally fixing said opposite ends one for alignment with each said axis; and a pair of torsion plates having first ends rigidly fixed one to each of said opposite ends of said torsion member and second ends rigidly fixed one to each said movable link remotely of said axis thereof.

24. An assembly according to claim 23, wherein said torsion member has open ends, said means each includes a pin removably, slidably insertable within one of said open ends, said second ends of said torsion plates have through mounting openings, each said movable link having a threaded stud removably insertable within one of said mounting openings of said torsion plates, and clamping nuts are removably fixed to said threaded studs for clamping said second ends of said torsion plates against each said movable link.

* * * * *